United States Patent [19]

Melchinger

[11] 4,080,123

[45] Mar. 21, 1978

[54] ROTARY LIQUID PUMP WITH SPACED DRIVE SHAFT CONNECTION MEANS

[75] Inventor: Wilhelm Melchinger, Unterensingen, Germany

[73] Assignee: Daimler-Benz Aktiengesellschaft, Germany

[21] Appl. No.: 693,979

[22] Filed: Jun. 8, 1976

[30] Foreign Application Priority Data

Jun. 13, 1975 Germany ..... 2526447

[51] Int. Cl.[2] ..... F01C 17/02; F04C 15/00; F16B 3/00; F16D 1/06

[52] U.S. Cl. ..... 418/182; 418/270; 403/359

[58] Field of Search ..... 418/69, 181, 182, 270; 403/359

[56] References Cited

U.S. PATENT DOCUMENTS

| | | | |
|---|---|---|---|
| 1,093,005 | 4/1914 | Myers | 418/181 |
| 2,975,964 | 3/1961 | Osterkamp | 418/182 |
| 3,697,201 | 10/1972 | Eickmann | 418/182 |

FOREIGN PATENT DOCUMENTS

| | | | |
|---|---|---|---|
| 1,128,055 | 8/1956 | France | 418/270 |
| 623,136 | 5/1949 | United Kingdom | 418/182 |

*Primary Examiner*—John J. Vrablik
*Attorney, Agent, or Firm*—Craig & Antonelli

[57] ABSTRACT

A rotating liquid pump, especially a vane cell pump, which is equipped with a disc-shaped rotor which together with a housing encloses at the circumference rotating feed spaces and which is non-rotatably but axially movably retained on a drive shaft by means of a form-locking connection while the disc-shaped rotor is axially fixed between housing walls that abut end-face at the disc-shaped rotor; the form locking connection is thereby subdivided into two separate axial mounting or support areas located as close to the disc-shaped rotor end faces as possible.

7 Claims, 3 Drawing Figures

FIG 1
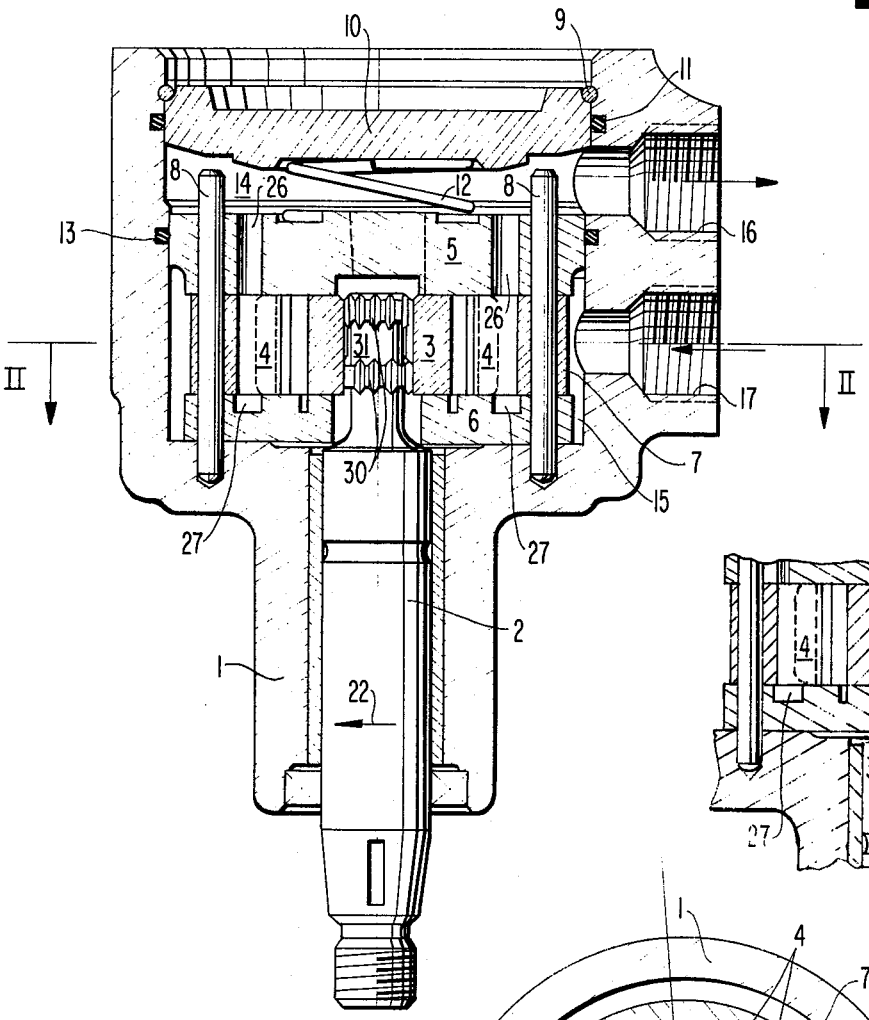
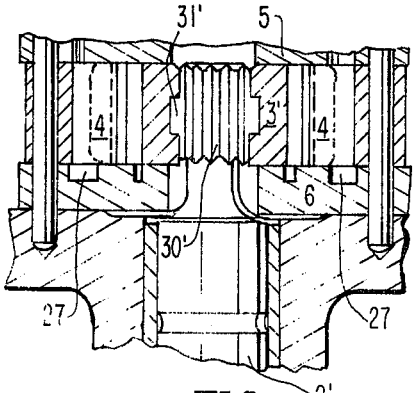
FIG 3
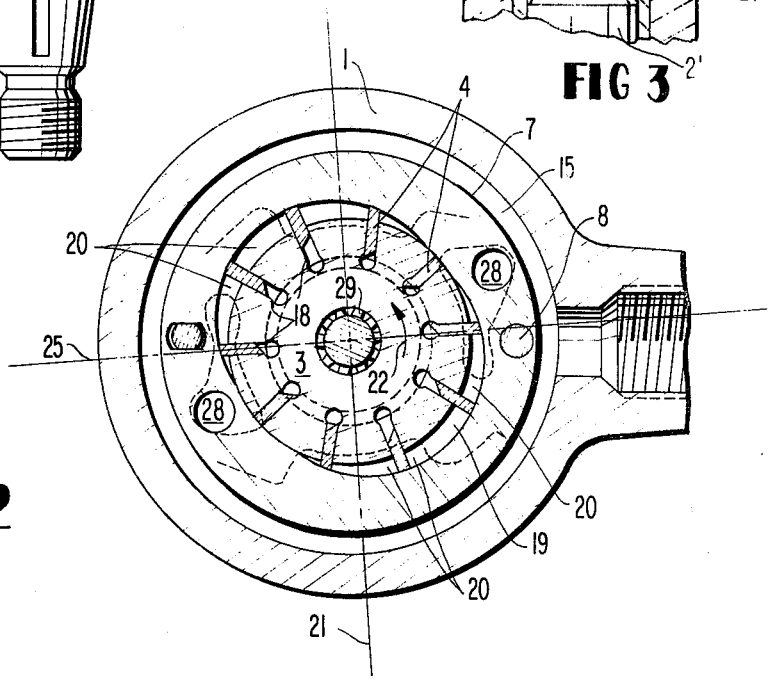
FIG 2

ROTARY LIQUID PUMP WITH SPACED DRIVE SHAFT CONNECTION MEANS

The present invention relates to a volumetrically effective rotary liquid pump, especially to a vane cell pump, with a disc-shaped rotor enclosing together with a rotating housing feed spaces at the circumference whereby the disc-shaped rotor is non-rotatably but axially movably held on a drive shaft by reason of a form-locking connection and is axially fixed between housing walls abutting end-face at the disc-shaped rotor.

Pumps of this type develop a whistling noise under certain operating conditions, especially at high feed pressures and small rotational speeds. The cause therefor is not completely clear; however, a fluttering of the vanes in the rotor slots and a fluttering of the rotor between the housing end walls appears to be indicated thereby, whereby it is still not clarified whether the vanes and the rotor flutter in the direction of the slots, i.e., radially and axially thereto and/or transversely thereto. This whistling may be disturbing especially with the use of such pumps in motor vehicles, for example, as steering servo pumps.

There has been no lack hereto in attempts to eliminate this whistling. One direction of this effort followed the approach to provide a certain torsional elasticity in the rotor drive of a pump, for example, a torsionally soft drive shaft between drive wheel and the pump rotor or a torsional elasticity in the wheel body of the drive wheel or gear. Similarly, one has also attempted to make the drive wheel of synthetic plastic material. These measures eliminate under certain circumstances the whistling noise, i.e., they might produce results from a functional point of view but are not acceptable from other points of views. The torsionally soft shaft or the drive wheel or drive gear with torsional elasticity are relatively expensive and the synthetic plastic drive wheel does not exhibit the necessary length of life and temperature resistance since one has to reckon with temperature rises of above 100° C.

According to a prior proposal of the assignee of this application, this whistling was to be eliminated by a continuously unequivocally effective hydraulic canting of the vanes in the rotor slots. These measures entailed a partial success but the whistling still occurred under certain operating conditions.

It is the aim of the present invention to eliminate the observed whistling noise in another way. This is achieved according to the present invention in that the form-locking connection is subdivided into two separate support areas located respectively as close as possible to the rotor end faces.

It is assured by the interruption of the support area of the form-locking connection into two axially spaced, mutually remote areas that also with a worn form-locking connection or with a form-locking connection having a large play, a certain minimum support width in the axial direction exists and a fluttering or tumbling or wobbling of the disk-shaped rotor on the form-locking connection with approximately spherically worn profile edges is precluded.

The interruption of the form-locking connection takes place exclusively for vibrational reasons. If interruptions should be known for other reasons, this does not prejudice the teachings according to the present invention. A wobbling tendency of the rotor is to be feared above all with short plug-in connections, and more particularly with relatively short plug-in connections (with an axial extension of less than one and one-half times the diameter) and with absolute short plug-in connections (for example, less than about 30 mm).

Appropriately, a pump with an internal spline hub profile in the rotor and a corresponding external spline shaft profile on the drive shaft may be so constructed that the spline hub profile and/or the spline shaft profile is axially interrupted in the center by a groove over a length amounting to about 30 to about 60% of the axial profile extension.

Accordingly, it is an object of the present invention to provide a vane pump which avoids by simple means the aforementioned shortcomings and drawbacks encountered in the prior art.

Another object of the present invention resides in a liquid pump, especially a vane pump with a disc-shaped rotor provided with radial slots accommodating the vanes, which avoids by simple means the whistling noises produced under certain operating conditions.

A further object of the present invention resides in a vane pump of the type described above in which the whistling noises are effectively eliminated, yet the pump parts are relatively simple and inexpensive and assure a long length of life as well as completely satisfactory temperature resistance.

Still a further object of the present invention resides in a vane-type pump in which a fluttering or tumbling of the disk-shaped rotor on the form-locking connection is precluded even in case of somewhat spherically worn profile edges.

These and other objects, features and advantages of the present invention will become more apparent from the following description when taken in connection with the accompanying drawing which shows, for purposes of illustration only, two embodiments in accordance with the present invention, and wherein:

FIG. 1 is a longitudinal cross-sectional view through a vane cell pump in accordance with the present invention;

FIG. 2 is a cross-sectional view through the pump at right angle to the cross-sectional view of FIG. 1 and taken along line II—II thereof; and FIG. 3 is a partial cross-sectional view of a further embodiment of a vane cell pump in accordance with the present invention.

Referring now to the drawing wherein like reference numerals are used throughout the two views to designate like parts, the pump illustrated in these two figures includes a pump housing 1 in which is supported the drive shaft 2 and in which are accommodated the essential pump parts. The essential pump parts include the disc-shaped rotor 3 non-rotatably mounted on the shaft 2 and having the vanes 4 as well as the two base plates 5 and 6 and the cam ring 7. The two base plates 5 and 6 and the cam ring 7 are held in a defined mutual circumferential and radial position by the guide or retaining pins 8 and are secured thereby against radial movements and rotation. The assembling opening of the pump housing 1 is axially sealingly closed off by the closure lid 10 secured by means of a spring ring 9 and utilizing the sealing ring 11. The main parts 3 to 6 of the pump receive an axial basic abutment independent of pressure by a compression spring 12 installed between the cover 10 and the upper base plate 5. The upper base plate 5 is additionally sealingly accommodated in the pump housing 1 by the use of a sealing ring 13 and separates the pressure side of the pump represented by the space 14 from the inlet side represented by the annular space 15. Both spaces 14 and 15 are adapted to be connected with a hydraulic system by way of the connections 16 and 17, respectively. A force corresponding to the level of the feed pressure prevailing in the pressure space 14 is hydraulically exerted on the upper base plate 5 by the feed pressure of the pump prevailing within this space 14, which sealingly compresses the main parts 3 to 6 of the pump axially against the pressure forces prevailing on the inside of the pump.

Axially extending radial slots 18 (FIG. 2) with parallel walls are machined into the rotor 3, into which are inserted the plane-parallel rectangular metal plates, the so-called vanes 4, which are able to radially slide therein with a slight predetermined clearance. The vanes 4 are in the axial direction exactly as long as the rotor 3 and the cam ring 7.

As shown in FIG. 2, inner contour 19 of the cam ring 7 is constructed in an oval manner according to a predetermined endless or closed cam configuration so that two sickle-shaped working spaces 20 result between the disc-shaped rotor 3 and the cam surface 19, which during the rotation of the disc-shaped rotor 3 are sped through in the circumferential direction by the vanes 4 subdividing these working spaces 20 into cells. The cam track 19 is radially outwardly inclined with respect to the circumferential direction within the areas of the line 21 during the rotation of the rotor in the direction of the arrow 22 and the feed cells formed between the vanes 4 become enlarged within this area (suction area). The working space 20 is connected end-face with the suction space 15 by recesses in the base plates 5 and 6. Within the area of the line 25 (pressure area), the feed cells become smaller again with the indicated rotor rotation (arrow 22) and the enclosed feed medium is displaced into the pressure space 14 by way of the apertures and recesses 26 and 27 connected end-face with the working space 20 and by way of the pressure bores 28 provided in the cam ring 7.

The form-locking plug-in connection between the shaft 2 and the disc-shaped rotor 3 consists of an internal spline hub profile 29 provided in the disc-shaped rotor 3 and of a corresponding external spline shaft profile 30 provided at the drive shaft 2. The spline hub profile 29 is provided uninterruptedly over the entire axial length of the disc-shaped rotor 3 whereas, in contrast thereto, the spline shaft profile 30 is interrupted by a wide groove 31 axially provided in the center of the profile and is subdivided into two separate support or bearer areas which are moved as closely as possible to the rotor end faces. The groove width in the illustrated embodiment is about 40% of the axial extension of the entire spline shaft profile, the preferred range for the width of the groove 31 being between about 30 and about 60%. The pump rotor 3 is thereby positively, rotatably guided at its end faces which counteracts a fluttering and wobbling tendency also with a worn spline fit or with a spline fit having a play.

In one specific embodiment, the ratio of maximum axial distance or axial extent of the form-locking connection to the diameter of the form-locking connection is smaller than about 1.5 and/or the axial distance or the axial extent of the form-locking connection amounts to less than 30 mm.

As shown in FIG. 3, the external spline shaft profile 30' provided at the drive shaft 2' is uninterrupted over its entire axial length whereas, in contrast thereto, the internal spline hub profile provided in the disc-shaped rotor 3' is axially interrupted in the center by a groove 31' over a length amounting to about 30 to about 60% of the axial profile extension.

While I have shown and described only two embodiments in accordance with the present invention, it is understood that the same is not limited thereto but is susceptible of numerous changes and modifications as known to those skilled in the art and I, therefore, do not wish to be limited to the details shown and described herein but intend to cover all such changes and modifications as are encompassed by the scope of the appended claims.

I claim:

1. A volumetrically effective rotating liquid pump comprising: a drive shaft, housing means, a unitary rotor which together with the housing means encloses at the circumference thereof rotating feed spaces, internal and external spline profile means provided between the rotor and the drive shaft so as to define form-locking connection means for non-rotatably but axially movably holding said rotor on the drive shaft, said rotor being axially fixed between housing walls abutting end-face at the rotor, characterized in that the form-locking connection means is subdivided into two separate axial support areas located relatively close to end-faces of the rotor, and in that at least one of the two spline profile means is interrupted axially in the center over a length amounting to about 30 to about 60% of the profile extension.

2. A pump according to claim 1, characterized in that the pump is a vane cell pump with vanes adapted to slide radially in radial slots of the rotor means.

3. A pump according to claim 1, characterized in that the interruption amounts to about 40% of the axial profile extension.

4. A volumetrically effective rotating liquid pump comprising: a drive shaft, housing means, a unitary disc-shaped rotor which together with the housing means encloses at the circumference thereof rotating feed spaces, said disc-shaped rotor being non-rotatably but axially movably held on the drive shaft by internal and external spline profile means between the disc-shaped rotor and the drive shaft so as to define a form-locking connection means, the disc-shaped rotor being axially fixed between housing walls abutting end-faces at the disc-shaped rotor, and axial dimensions of the form-locking connection means being such that at least one of the two criteria consisting of a ratio of maximum axial dimension of the form-locking connection means to the diameter of the form-locking connection means being smaller than 1.5 and the axial dimension of the form-locking connection means being at most equal to about 30 mm, characterized in that the form-locking connection means is subdivided exclusively for preventing a tumbling oscillation of the disc-shaped rotor on the form-locking connection means into two separate axial support areas located relatively close to respective end-faces of the disc-shaped rotor, and in that at least one of the two spline profile means is interrupted axially in the center over a length amounting to about 30 to about 60% of a profile extension of the drive shaft.

5. A pump according to claim 4, characterized in that the spline profile means of the disc-shaped rotor is interrupted axially and the spline profile means of the drive shaft means is uninterrupted over its entire axial length.

6. A pump according to claim 4, characterized in that the axial dimension of the form-locking connection means is smaller than 30 mm.

7. A pump according to claim 6, characterized in that the interruption amounts to about 40% of the axial profile extension.

* * * * *